US006745860B2

(12) United States Patent
Yabe

(10) Patent No.: US 6,745,860 B2
(45) Date of Patent: Jun. 8, 2004

(54) ENGINE COOLING AIR PASSAGE FOR CONSTRUCTION EQUIPMENT

(75) Inventor: Mitsuo Yabe, Newcastle upon Tyne (GB)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/756,653

(22) Filed: Jan. 10, 2001

(65) Prior Publication Data

US 2001/0007292 A1 Jul. 12, 2001

(30) Foreign Application Priority Data

Jan. 12, 2000 (JP) ..... 2000-003629

(51) Int. Cl.[7] ..... B60K 1/00
(52) U.S. Cl. ..... 180/68.1
(58) Field of Search ..... 180/68.1, 68.2, 180/68.3, 68.4, 68.6; 123/41.01, 41.31, 41.48, 41.49; 165/122

(56) References Cited

U.S. PATENT DOCUMENTS

| | | | | |
|---|---|---|---|---|
| 1,361,567 A | * | 12/1920 | Diver | 180/68.1 |
| 2,319,002 A | * | 5/1943 | Kramer | 180/68.1 |
| 4,071,009 A | | 1/1978 | Kraina | |
| 4,854,278 A | * | 8/1989 | Honecker | 123/198 E |
| 5,365,025 A | * | 11/1994 | Kraai et al. | 181/249 |
| 5,816,350 A | * | 10/1998 | Akira et al. | 180/68.1 |
| 5,816,351 A | * | 10/1998 | Akira et al. | 180/68.1 |

FOREIGN PATENT DOCUMENTS

| | | | |
|---|---|---|---|
| EP | 0 734 897 | | 10/1996 |
| EP | 0 799 979 A1 | | 10/1997 |
| EP | 0 947 706 A1 | | 10/1999 |
| GB | 1 433 596 | | 4/1976 |
| GB | 2 308 343 A | | 6/1997 |
| JP | 5497913 | * | 8/1979 |
| JP | 59-164225 | * | 9/1984 |
| JP | 63247118 | * | 10/1988 |
| JP | 2245427 | * | 10/1990 |
| JP | 3-64121 | | 6/1991 |
| JP | 455527 | * | 2/1992 |
| JP | 6227267 | * | 8/1994 |
| JP | 2548492 | | 5/1997 |
| JP | 2775037 | | 5/1998 |
| JP | 11-139170 | * | 5/1999 |

* cited by examiner

*Primary Examiner*—Bryan Fischmann
(74) *Attorney, Agent, or Firm*—Armstrong, Kratz, Quintos, Hanson & Brooks, LLP.

(57) ABSTRACT

An engine cooling air passage for construction equipment, which is capable of reducing noise released from a cooling air exhaust port with back pressure of cooling air remaining low and making an engine room compact, is provided. To this end, in the engine cooling passage, a fan air diversion passage (53) of a predetermined length, which has a fan air diversion opening **(53*a*) located near an outer periphery portion of a cooling fan (16) and taking in a cooling air blown by the cooling fan (16), at one end side, and an opening (53*b*) located near a lateral end portion of a counterweight (61) and discharging the cooling air taken in to an outside, at the other end side, is formed either in a front portion of or in front of the counterweight (61)**.

5 Claims, 12 Drawing Sheets

ENGINE COOLING AIR PASSAGE FOR CONSTRUCTION EQUIPMENT

This application claims the benefit of JP 2000-003629 filed Jan. 12, 2000.

TECHNICAL FIELD

The present invention relates to an engine cooling air passage for construction equipment.

BACKGROUND ART

Recently, due to environmental sensitivity, equipment causing less noise to the environment (hereinafter called ambient noise) is demanded also in construction equipment. For this reason, conventionally, the front and the back, the left and the right side, and the top and the bottom of the entire bodies of an engine, a cooling fan and a radiator in front of the engine are covered with partition walls or wall surfaces of the other devices in such a manner as to be wrapped with them, and thereby an engine room is constructed. A cooling air inlet port is provided at an upper partition wall in front of the radiator of the engine room, and a cooling air exhaust port is provided at an upper partition wall at the back of the engine room to thereby form an engine cooling air passage, whereby cooling air is taken in from an upper front portion of the engine room and is discharged to an upper rear portion thereof. The structure in which noises of a cooling fan and an engine are not directly released outside according to the above configuration is generally achieved.

However, as for an engine cooling air passage for construction equipment, there always exists a demand for the solution to eliminate the contradictory phenomena in these three items: securing sufficient opening areas for the inlet port and the exhaust port to obtain sufficient amount of engine cooling air; the resultant increase in engine noise released to the outside; and increase in the size of the engine room to prevent the noise release.

The above problems the solution to which is demanded are explained below by separating them into the cooling air inlet port side and the cooling air exhaust port side.

(1) In the cooling air inlet port, the inlet port is provided in the upper partition wall in front of the radiator of the engine room, whereby the engine room is substantially extended in front of the radiator, which results in the increase in size and becomes a disadvantage to small-sized construction equipment. However, since a space in front of the radiator serves as a noise-suppressing duct, noise release from the inlet port can be reduced to the practical level. Further, for example, Japanese Utility Model Laid-open No. 3-64121 discloses the means for reducing the extension in front of the radiator by 50 percent to secure the inlet amount of cooling air, which proves effective.

(2) As for the cooling air exhaust port, the exhaust port can be easily provided in the upper partition wall at the back of the engine room without increasing the size of the engine room. However, this results in direct opening of the upper portion of the engine room, whereby engine noise, and the noises of a power transducer such as a hydraulic pump, for example, are directly released from the exhaust port without being attenuated, thus making it impossible to reduce the noise.

As is generally known, even if one of two equal sound sources (in this case, the cooling air inlet port and the cooling air exhaust port) is reduced to zero, the noise reduction effect of only about 3 dB is obtained if the other one remains as it is. Consequently, in the above situation, the noise reduction effect of the cooling air inlet port is buried, and construction equipment with less noise is not provided. Hence, it is one of important issues to form an engine cooling air passage in which discharge of sufficient amount of cooling air is compatible with sufficient reduction in noise release.

The above issue will be explained with FIG. 17 and FIG. 18.

FIG. 17 is a fragmentary perspective view of a hydraulic shovel having an engine room to which an engine cooling air passage according to a prior art is applied. In the hydraulic shovel, an upper revolving superstructure 2 is rotatably mounted at approximately a center of a top portion of the a base carrier 1, and at an upper rear end of the upper revolving superstructure 2, placed is a counterweight 3, in front of which, placed are an engine room 4, a hydraulic fluid tank 5 and a fuel tank 6. At a front part of the upper revolving superstructure 2, an operator's cab 7 is placed at a left side, and a working machine 8 is attached at approximately a center portion. In a top face of the engine room 4, a cooling air inlet port 11 is provided at a left end portion of a vehicle body and a cooling air exhaust port 12 is provided at a right end portion of the vehicle body.

FIG. 18 is a fragmentary sectional top view of the engine room of FIG. 17, and FIG. 19 is a fragmentary sectional side view of the engine room. It should be noted that the broken line arrow represents a vector of a cooling fan blown-off air, while the solid line arrow represents a flow of a cooling air in FIGS. 18 and 19, and the same thing will apply hereinafter.

In FIGS. 18 and 19, entire bodies of an engine 13, an auxiliary pump 14, a hydraulic pump 15 as a power transducer, a cooling fan 16, a radiator 17, an oil cooler 18 and an air conditioning condenser 19 are covered with a front partition wall 21, a rear partition wall 22, a left side partition wall 23, a right side partition wall 24, an upper partition wall 25 and a lower partition wall 26 to define the engine room 4. The upper partition wall 25 is provided with the cooling air inlet port 11 in front of the radiator 17 and with the cooling air exhaust port 12 behind the engine 13.

In FIG. 18, in order to exhaust sufficient amount of cooling air, it is necessary to reduce exhaust resistance (hereinafter, called back pressure). The first problem regarding this is the following point. Normally, the vectors of blown-off air from the cooling fan 16 have the property that they have higher speed as they are away from the center of the fan in a radial direction and they tend to spread in the radial direction due to centrifugal force. In the engine room 4 of a normal size as shown in FIG. 18, the flow of the cooling air cannot go along the aforesaid vectors of the blown-off air and is disturbed as shown by the solid line arrows, and thus it does not pass smoothly, whereby back pressure occurs. The second problem is as follows. The cooling air exhaust port 12 is opened at the position where an unobstructed view of the engine 13 and the hydraulic pump 15 being the noise sources can be obtained if the opening area is increased in order to reduce the back pressure occurring due to the resistance of the cooling air exhaust port 12, and therefore the noise therefrom are directly released outside without being attenuated, thus providing less effect of reducing the ambient noise.

Hence, the art of providing the cooling air passage in which sufficient discharge of cooling air is compatible with sufficient reduction in noise release is always demanded.

As the fist prior art for solving the above problem, for example, Japanese Patent No. 2775037 discloses the art of a sound insulation housing having an inlet and discharge duct which is designed to attenuate inlet noise and exhaust noise. FIG. 20 and FIG. 21 are explanatory views of the art disclosed in the same Patent, FIG. 20 is a partially omitted fragmentary sectional top view of a hydraulic shovel to which the art of the sound insulation housing is applied, and FIG. 21 is a perspective view of a counterweight of the hydraulic shovel.

In FIG. 20, an upper revolving superstructure 32 is rotatably mounted at approximately a center of an upper portion of a base carrier 31, and a counterweight 33 is placed at a rear end portion of the upper revolving superstructure 32. In front of the counterweight 33, placed are an engine 34, a hydraulic device 35 such as a hydraulic pump, engine cooling devices such as a cooling fan 16 and a radiator 17. Further, an operator's cab 38 is placed at a left side of a front part of the upper revolving superstructure 32, and a working machine 39 is placed at approximately a center portion thereof. It should be noted that regarding the working machine 39, only a mounting boss is illustrated. The engine 13, the hydraulic device 35, the cooling fan 16 and the radiator 17 are enclosed entirely with a closed chamber housing structure 40. The closed chamber housing structure 40 is defined by the counterweight 33, a front partition wall 48 surrounding a concave space in a plan view in front of the counterweight 33, an engine cover and a bottom plate not illustrated of a known art.

Further, as shown in FIG. 21, the counterweight 33 is formed between a panel wall 47 provided in a circumferential direction so as to be along an arc-shaped outer wall 49 with a predetermined space inside from the arc-shaped outer wall 49 of the counterweight 33 and the aforesaid arc-shaped outer wall 49. The counterweight 33 includes a exhaust duct 41 having a exhaust passage 42 for engine cooling air, and an exhaust port 43 opened downward to the outside at an end portion of the depth of the exhaust duct 41 in the circumferential direction. Further, at a right side of a front part of the upper revolving superstructure 32, an inlet passage 45 is provided for engine cooling air, and an inlet duct 44 connected to a right side of a front end portion of the counterweight 33 is placed. The inlet passage 45, the concave space in front of the counterweight 33, and the exhaust passage 42 and the exhaust port 43 define the engine cooling air passage.

Further, as a second prior art, there is a cooling device for an engine described in, for example, Japanese Utility Model No. 2548492. FIG. 22 to FIG. 24 are explanatory views of the cooling device described in the same Utility Model. FIG. 22 is a perspective view of an essential part of a hydraulic shovel including the cooling device, FIG. 23 is a partially cutaway plan view of an essential part of the hydraulic shovel including the cooling device, and FIG. 24 is a sectional view taken along the line 24—24 in FIG. 23.

At a rear end portion of the upper revolving superstructure 2 rotatably mounted on a top portion of the base carrier 1, placed is the counterweight 3, in front of which the engine room 4 is provided. In the engine room 4, laterally (in a left and right direction of a vehicle) placed are the engine 13, the cooling fan 16 driven by the engine 13, and the radiator 17 at an upstream of cooling air from the cooling fan 16. In a guard plate with which a top surface and left and right side surfaces of a rear portion of the upper revolving superstructure 2 are covered, provided is an air inlet port 91 opened in a top surface in front of the radiator 17. A noise suppressing duct 92 is vertically formed inside the counterweight 3, and an outlet 93 for air exhausted from the noise suppressing duct 92 is formed in a top surface of the counterweight 3. In a lower end portion of the noise suppressing duct 92, an air inlet port 97 is opened in parallel with a longitudinal direction of the engine 13 (left and right direction of the vehicle) at the front portion of the counterweight 3. Further, a noise absorbing material 96 is attached on a inner surface of the noise suppressing duct 92. When an outside air taken in from the air inlet port 91 as shown by the arrow 94 is exhausted from the noise suppressing duct 92 via the inside of the engine room 4 as shown by the arrow 95, part of the engine noise in air is designed to be absorbed in the noise absorbing material 96.

According to the above configuration, the engine room 4 is communicated with and opened to the outside via the noise suppressing duct 92. As a result, the outside air introduced by the cooling fan 16 via the radiator 17 is quickly exhausted from the engine room 4 via the noise suppressing duct 92 after cooling the engine 13 and thus it can sufficiently cools the engine room 4.

However, the above prior arts have the following disadvantages.

The art disclosed in the aforesaid Japanese Patent No. 2775037 has the following disadvantage.

In FIG. 20, the noises from the engine 34 and the hydraulic device 35 are released outside via the exhaust duct 41 placed at the back of the counterweight 33, which is highly effective at reducing noise. However, all of the cooling air for the radiator 17 has to pass the exhaust passage 42.and the exhaust port 43 inside the exhaust duct 41, whereby the back pressure of the cooling air increases and air flow decreases, thus reducing cooling efficiency.

If an outer diameter of the cooling fan 36 is set to be larger, or the rotational frequency is set to be higher in order to compensate the decrease in the air flow to prevent the engine 34 from overheating, not only the noise from the cooling fan 16 increases, but also horse power consumption increases. Increase in the horse power consumption of the cooling fan 16 results in reduction in actual output power of the engine 34 (output power usable for driving the working machine 39) and rise in fuel consumption rate per actual output power, which reduces the commercial value of the hydraulic shovel.

Further, in the embodiment of Japanese Patent No. 2775037, a small-sized rotary hydraulic excavation vehicle (so-called a small back rotary hydraulic shovel) as shown in FIG. 20 is disclosed. However, when the excavation vehicle is in a medium and large size, the engine is large, whereby a larger cooling air flow is required for the engine, and thus the disadvantage accompanying a rise in the back pressure of the aforesaid cooling air is made conspicuous. Accordingly, it is difficult to say that this structural arrangement can be generally used for small-sized to large-sized hydraulic shovels.

Next, the cooling device for the engine described in Japanese Utility Model No. 2548492 has the following disadvantage.

An outside air taken in by the cooling fan 16 is exhausted to the outside via the noise suppressing duct 92 inside the counterweight 3 after cooling the engine 13, and therefore all the air inside the engine room 4 goes to the inlet port 97 at the lower portion of the front surface of the counterweight 3. In other words, the noise suppressing duct 92 inside the counterweight 3 cools the radiator 17 as well as the engine room 4. Thus, most of the air from the cooling fan 16 collides against the partition walls on the left and right and the top and bottom of the engine room 4, and it is difficult to say that sufficient air flow exhausted from the inlet port 97 can be obtained. Specifically, it is strongly desired that a larger amount of cooling air be secured.

As described above, three needs of discharge of sufficient amount of cooling air, sufficient reduction in noise release, and reduction in size of the engine room are not eliminated and remain contradicting each other.

SUMMARY OF THE INVENTION

The present invention is made in view of the above disadvantages, and its object is to provide an engine cooling air passage for construction equipment capable of reducing noise release from a cooling air exhaust port with the back pressure of the cooling air remaining low and of making an engine room compact.

In order to attain the above object, a first configuration of an engine cooling air passage for construction equipment according to the present invention is in an engine cooling air passage for construction equipment in which an engine room enclosing an engine, a radiator and a cooling fan for cooling the radiator is adjacently placed in front of a counterweight at a rear end portion of a vehicle so that a direction of an axis of rotation of the cooling fan is in a lateral direction of the vehicle, and an outside air is taken in by the cooling fan and is discharged to an outside via an inside of the engine room, having the configuration in which a fan air diversion passage of a predetermined length, which has a fan air diversion opening located near an outer periphery portion of the cooling fan and taking in a cooling air blown by the cooling fan, at one end side, and an opening located near a lateral end portion of the counterweight and discharging the cooling air taken in to an outside, at the other end side, is formed either in a front portion of or in front of the counterweight.

The air blown by the rotation of the cooling fan normally has the property that the air speed is higher as it is farther from the fan center in the radial direction and that the it tends to spread in the radial direction by centrifugal force. Accordingly, the air at a very high speed which is blown from the outer periphery portion of the cooling fan spread outward to the engine room partition wall near the outer periphery portion of the air outlet.

According to the above first configuration, the fan air diversion opening is provided in the engine room partition wall near the outer periphery portion of the cooling fan. Thus, the high-speed cooling air from the outer periphery portion of the fan air outlet directly flows into the fan air diversion opening without resistance before cooling the engine, and flows while maintaining the high speed in a state near laminar flow by the fan air diversion passage and is exhausted to an outside from the opening at the other end side.

Accordingly, a large amount of cooling air per opening area is exhausted from the fan air diversion passage, while in the engine room, an eddy flow of the high-speed cooling air reflected at the partition walls is eliminated and the residual air flows smoothly, thus drastically reducing the back pressure of the cooling fan owing to both the effects. Consequently, even if the opening area of the cooling air exhaust port at the top surface at the downstream side of the engine room is reduced to be less than the opening area of the cooling air exhaust port according to the prior art by the opening area of the fan air diversion passage or more, the back pressure can be reduced by the same amount or less, thus making it possible to secure the same amount of engine cooling air passing the radiator or more.

As a result, the noise in the engine room is attenuated by the fan air diversion passage of a predetermined length and released outside on one hand, and it is released from the cooling air exhaust port with the drastically reduced area on the other hand, thus making it possible to drastically reduce the noise release from the engine room.

When the fan air diversion passage is formed in the front portion of the counterweight, the space for placing the diversion passage becomes unnecessary correspondingly, thus reducing the distance between the engine room and the counterweight to make it possible to reduce the engine room and construction equipment in size.

As a result, the needs of the three items: discharge of the sufficient amount of cooling air, sufficient reduction in noise release, and compact engine room: can be realized at the same time.

Further, in the engine cooling air passage for the construction equipment, the configuration in which noise absorbing materials are attached on an inner wall of the fan air diversion passage may be suitable.

According to the above configuration, since the noise passing through the fan air diversion passage contacts the noise absorbing materials over the large area, the noise in the high-frequency band is drastically attenuated by the noise absorbing materials in addition to the noise in the low-frequency band being attenuated by the diversion passage of the predetermined length itself. As a result, not only is the noise further attenuated, but it also becomes less offensive to the ear, thus making it easy to correspond to noise control.

A second configuration of an engine cooling air passage for construction equipment according to the present invention is in an engine cooling air passage for construction equipment in which an engine room enclosing an engine, a radiator and a cooling fan for cooling the radiator with a cover is provided, and an outside air is taken in by the cooling fan and is discharged to an outside via an inside of the engine room, having the configuration in which a fan air diversion duct of a predetermined length, which has a fan air diversion opening located near an outer periphery portion of the cooling fan and taking in a cooling air blown by the cooling fan, at one end side, and an opening for discharging the cooling air taken in to the outside, at the other end side, is provided at least either one of at a side of or above the engine.

According to the above configuration, the fan air diversion opening is provided in the engine room partition wall at a side of and/or above the engine. Thereby, the high-speed cooling air from the outer periphery portion of the fan air outlet directly flows into the fan air diversion opening without resistance before cooling the engine, flows while maintaining the high-speed in a state near the laminar flow by the fan air diversion duct, and is exhausted to the outside from the opening at the other end side. Accordingly, the same operation and effects as in the case of the fan air diversion passage according to the above first configuration is obtained, and the needs in the three items of the sufficient discharge of the cooling air, sufficient reduction in noise release, and a compact engine room can be realized at the same time.

Further, an optional layout can be set such as lateral placement (an axis of rotation of the engine is placed in parallel with the lateral direction of the vehicle), vertical placement (the axis of rotation of the engine is placed in parallel with the longitudinal direction of the vehicle) and the like, and therefore the engine room according to the second configuration can be generally applicable to medium and large sized construction equipment. Above all, since the engine room according to the second configuration can be formed into approximately a rectangular parallelepiped shape, it is applicable to portable engine loaded devices such as a portable engine motor, a portable compressor and the like in which the appearance of the engine room is set by the location of the portable products. By applying the engine room to these devices, the most suitable engine loaded devices with excellent appearance and reduction in noise can be obtained.

Further, in the engine cooling air passage for the construction equipment, the configuration in which noise absorbing materials are attached on an inner wall of the fan air diversion duct may be suitable.

According to the above configuration, the same operation and effects as in the above similar configuration can be obtained. Thereby, the noise passing through the inside of the fan air diversion duct is further drastically attenuated in the high-frequency band by the noise absorbing material in addition to the attenuation in the low-frequency band by the diversion duct of a predetermined length itself. As the result, not only the noise is further attenuated, but also it becomes less offensive to the ear, thus making it easy to correspond to noise control.

Furthermore, in the engine cooling air passage for the construction equipment, the configuration in which oil pipelines an provided inside the engine room and connect an oil cooler for cooling working fluid of a hydraulic device and a working fluid tank are placed in an inner space of the fan air diversion duct.

According to the above configuration, the space for placing the piping can be reduced and the pipelines can be cooled at the same time. Specifically, as for the space for placing the piping, the pipelines are normally placed with a predetermined space being provided around them for the prevention of the interference with the vibrations caused by the pressure pulsation of inner fluid and for maintainability (easiness in individual attachment and detachment). Thus, the placement of the piping requires a space several times as large as the volume of the pipelines, which makes a large dead space. According to the above configuration, the pipelines are placed in the fan air diversion duct, whereby the aforesaid dead space is used as the passage for the fan air, and therefore the saving effect of the space is large, thus making it possible to make the construction equipment compact.

Next, as for the cooling of the pipelines, in the construction equipment such as a hydraulic shovel, the working machine, carrier, and the like are driven by hydraulic pressure, and therefore large sized oil cooler for controlling a rise in working fluid temperature has been essential so far. According to the above configuration, since the oil pipelines for connecting the oil cooler and the working fluid tank are placed inside the fan air diversion duct, they are cooled by the cooling air at the temperature almost equal to the outside temperature, which is blown from the outer periphery portion of the air outlet of the cooling fan. Thereby, the heat amount which has to be cooled by the oil cooler decreases, thus making it possible to reduce the thickness of the core of the air-cooled type of oil cooler and increase the intervals between the cooling fins under a constant amount of cooling air. Consequently, the oil cooler can be reduced in size, and the air flow of the cooling fan increases while passage resistance of the cooling air is reduced, thereby making it possible to reduce the rotational frequency of the cooling fan or reduce the cooling fan in size correspondingly, whereby consumption horse power of the cooling fan decreases. Thereby, the fuel economy of the construction equipment can be improved, and the surplus engine horse power can be used for the working machine, carrier, and the like, thus making it possible to improve operability and traveling.

As the result of the above, in addition to the same operation and effects as in the aforesaid second configuration, compact construction equipment with less fuel consumption can be realized.

BRIEF DESCRIPTION OF THE DRAWINGS

FIG. 8A is a top view, and FIG. 8B is a front view;

FIG. 16A is a top view of a counterweight, and FIG. 16B is a front view of the counterweight;

BEST MODE FOR CARRYING OUT THE INVENTION

Preferred embodiments of an engine cooling air passage for construction equipment according to the present invention will be explained in detail below with reference to the drawings. Explanation is made with use of a hydraulic shovel as an example of the construction equipment.

A first embodiment will be explained based on FIG. 1 to FIG. 9.

Figure 1:
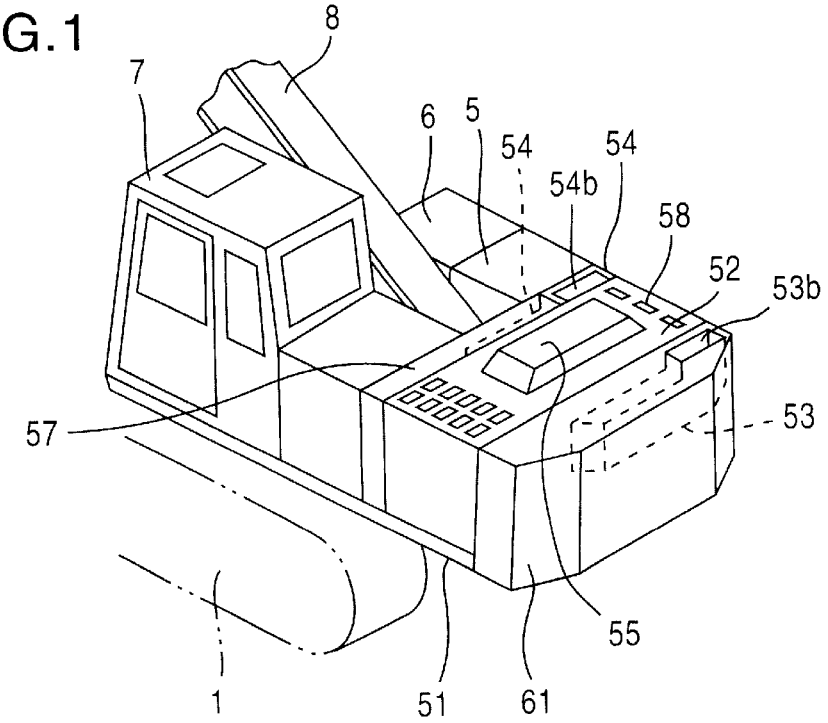
FIG. 1 is a fragmentary perspective view of a hydraulic shovel to which an engine cooling air passage of a first embodiment of the present invention is applied.
Figure 17:
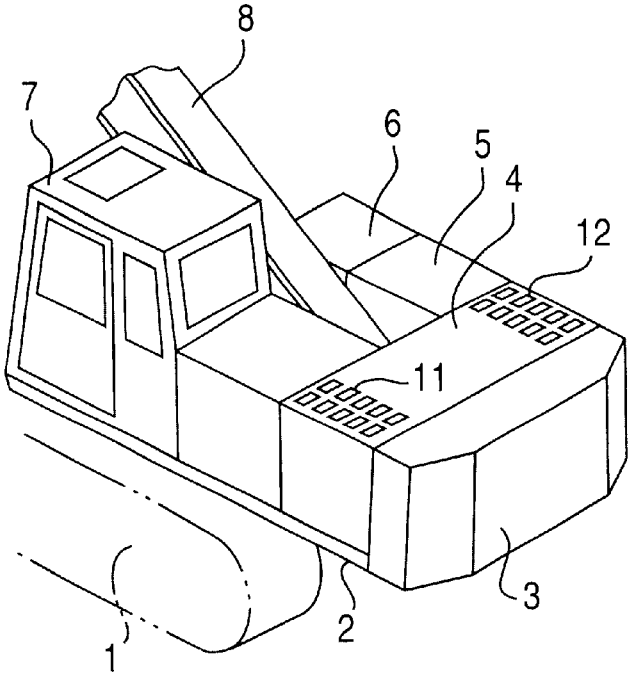
FIG.17 PRIOR ART
FIG. 17 is a fragmentary perspective view of a hydraulic shovel having an engine room to which an engine cooling air passage of a prior art is applied.

FIG. 1 is a fragmentary perspective view of a hydraulic shovel to which an engine cooling air passage according to the first embodiment is applied. It should be noted that the same components as in FIG. 17 are given the identical numerals and symbols and the explanation thereof will be omitted below.

In FIG. 1, an upper revolving superstructure 51 is rotatably mounted on approximately a center of a top portion of a base carrier 1. A counterweight 61 is provided at an upper rear end portion of the upper revolving superstructure 51, and in front of the counterweight 61, placed is an engine room 52 with its cooling air direction being lateral. On a top surface of the engine room 52, a cooling air inlet port 11 is provided at a left end portion of a vehicle body, and a cooling air exhaust port 58 is provided at a right end portion of the vehicle body, respectively. A first fan air diversion passage 53 is formed in a lateral direction of the vehicle in a front portion of the counterweight 61, and an opening 53*b* at a cooling air exhaust side of the first fan air diversion passage 53 is provide at a predetermined position on a right side of the front portion of the counterweight 61. The opening 53*b* is provided at a predetermined position in the top surface on the right side of the front portion of the counterweight 61 in this embodiment, but it may be provided in a side surface of the vehicle.

A second fan air diversion passage 54 is provided in the lateral direction of the vehicle at a side surface of the engine room 52, which is at the front side of the vehicle body. An opening 54*b* at a cooling air exhaust side of the second fan air diversion duct 54 is provided at a predetermined position on the right side of the rear portion of the engine room 52. The opening 54*b* is provided at a predetermined position in the top surface on the right side of the rear portion of the engine room 52 in this embodiment, but it may be provided in a side surface of the vehicle. A third fan air diversion duct 55 is placed in the lateral direction of the vehicle at approximately a center of the top portion of the engine room 52. Above the second fan air diversion duct 54, a gap cover 57 is placed to almost join with a top face cover of the engine room 52 on their surfaces.

Figure 2:
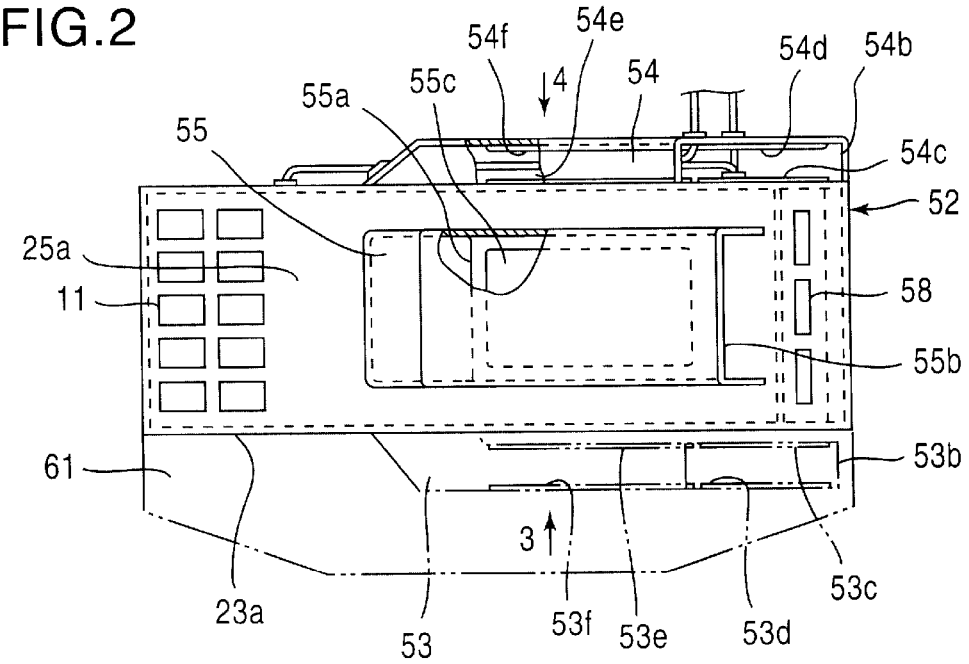
FIG. 2 is a top view of an engine room according to the first embodiment seen from a counterweight side.
Figure 3:
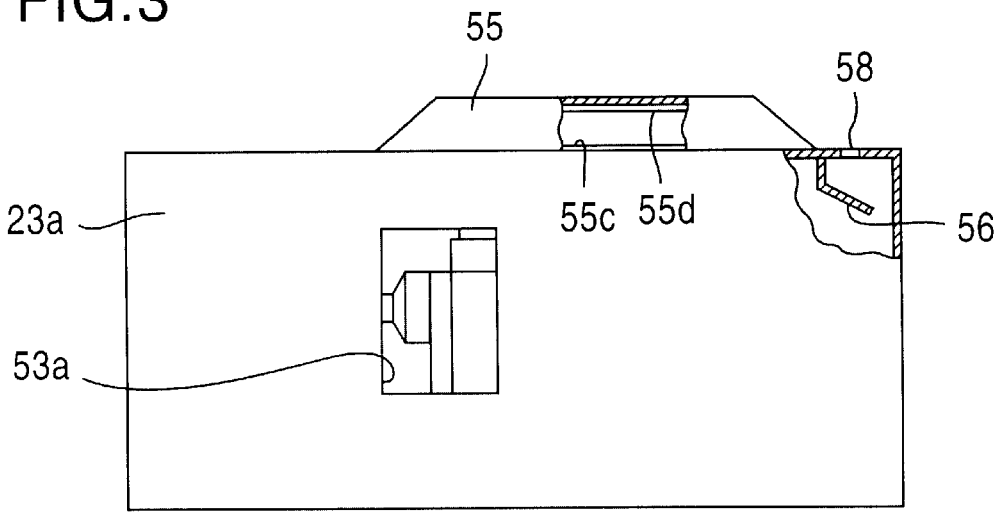
FIG. 3 is a side view seen from the arrow 3 in FIG. 2.
Figure 4:
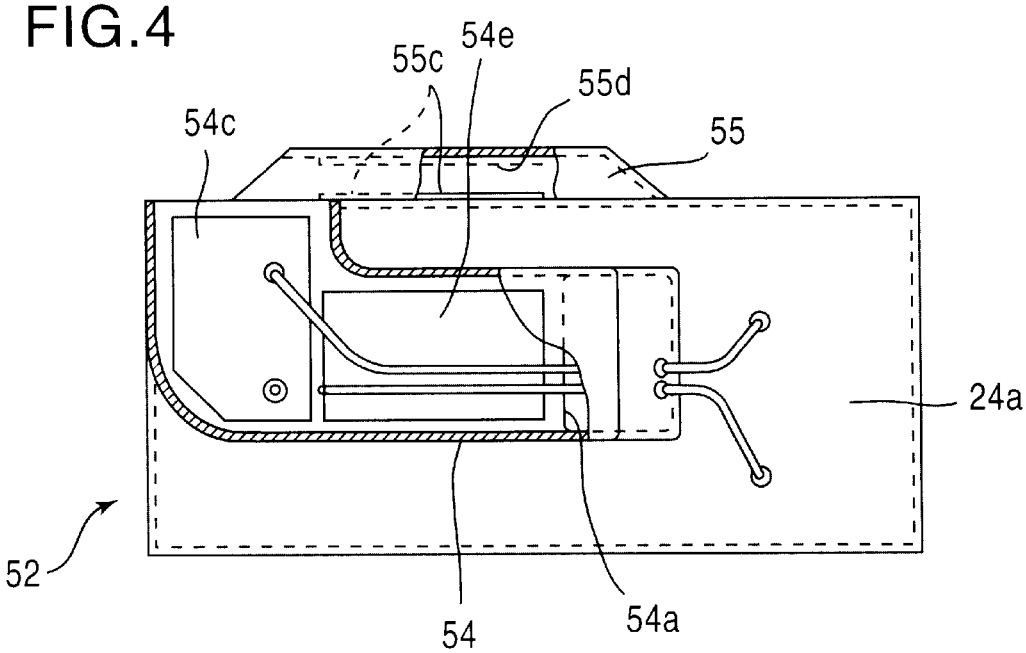
FIG. 4 is a side view seen from the arrow 4 in FIG. 2.
Figure 5:
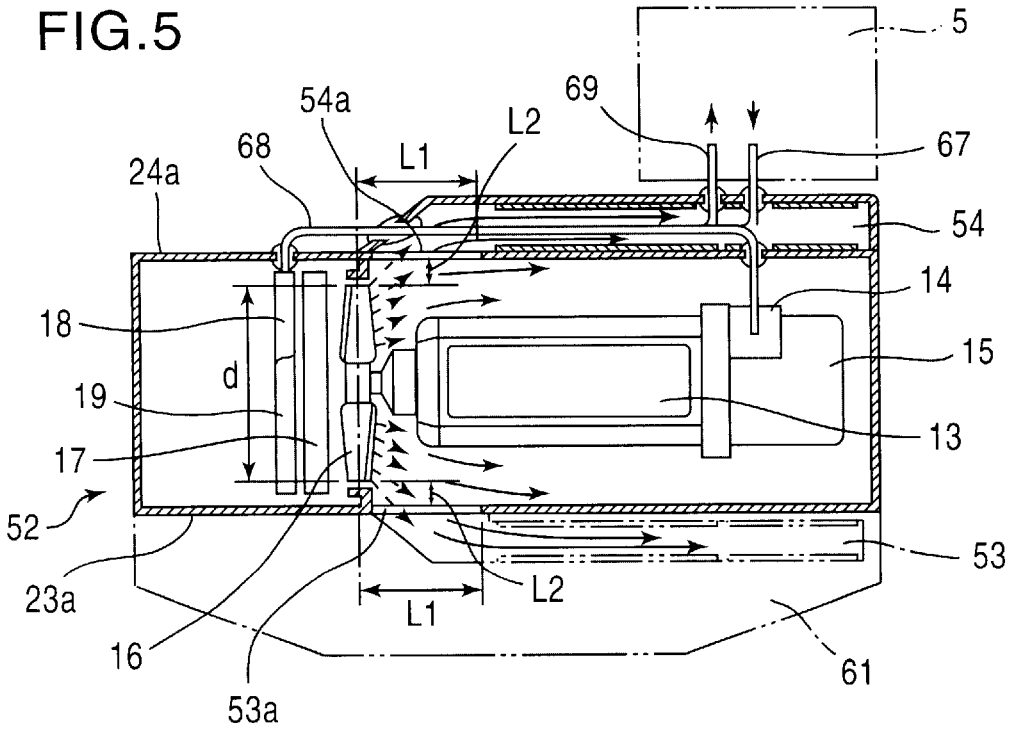
FIG. 5 is a fragmentary sectional view of FIG. 2.
Figure 6:
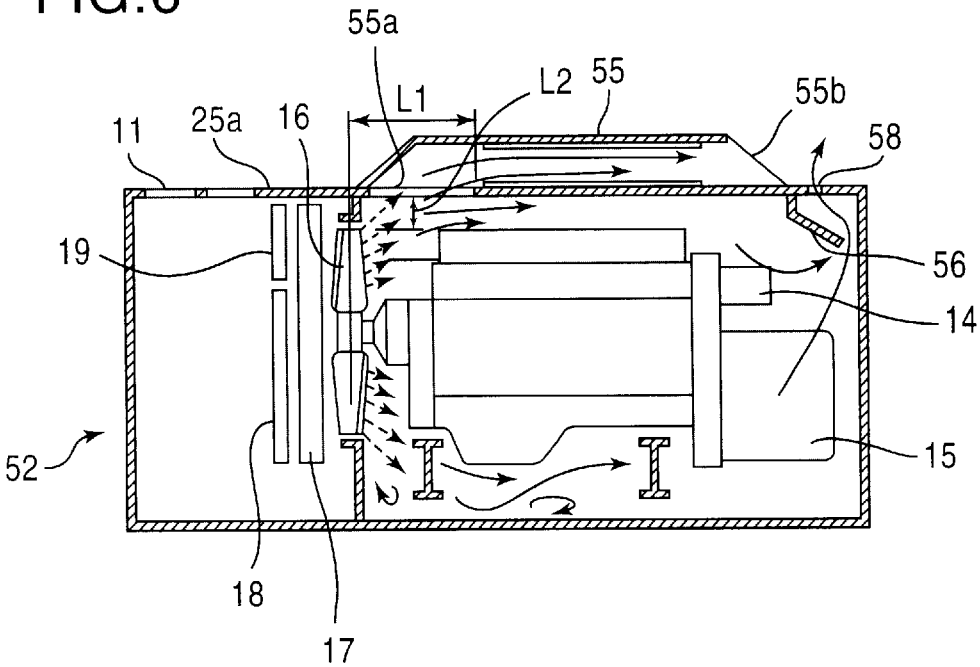
FIG. 6 is a fragmentary sectional view of FIG. 3.
Figure 7:
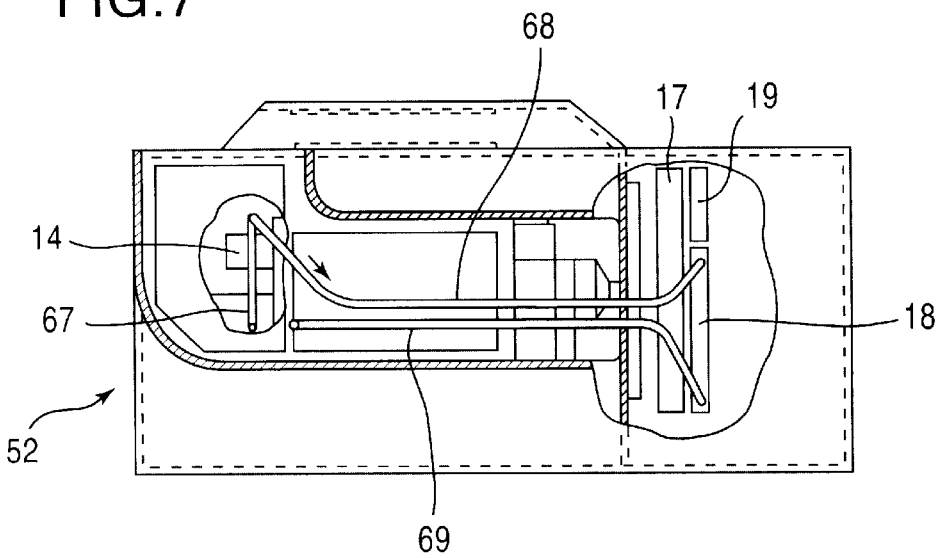
FIG. 7 is a fragmentary sectional view of FIG. 4.
Figure 18:
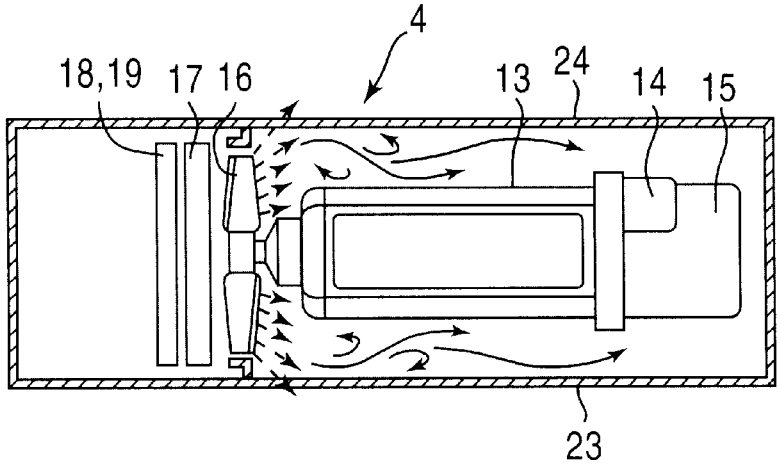
FIG.18 PRIOR ART
FIG. 18 is a fragmentary sectional top view of the engine room in FIG. 17.
Figure 19:
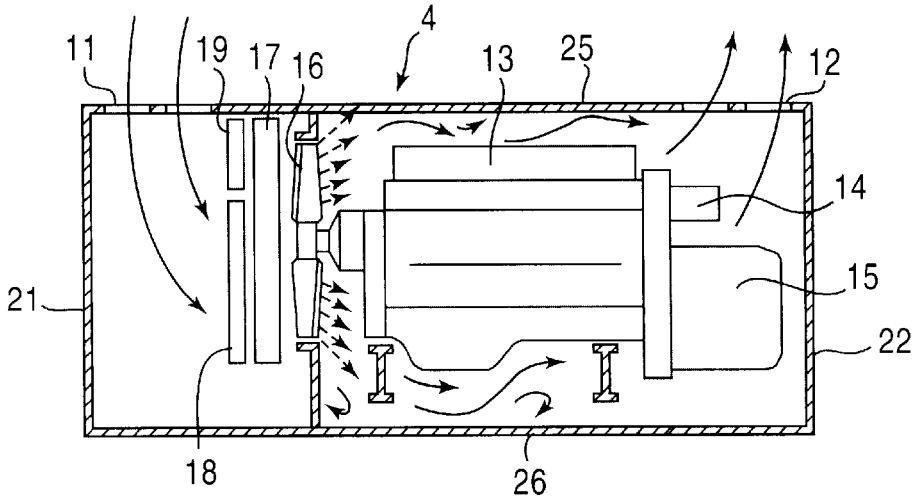
FIG.19 PRIOR ART
FIG. 19 is a fragmentary sectional side view of the engine room in FIG. 17.
Figure 20:
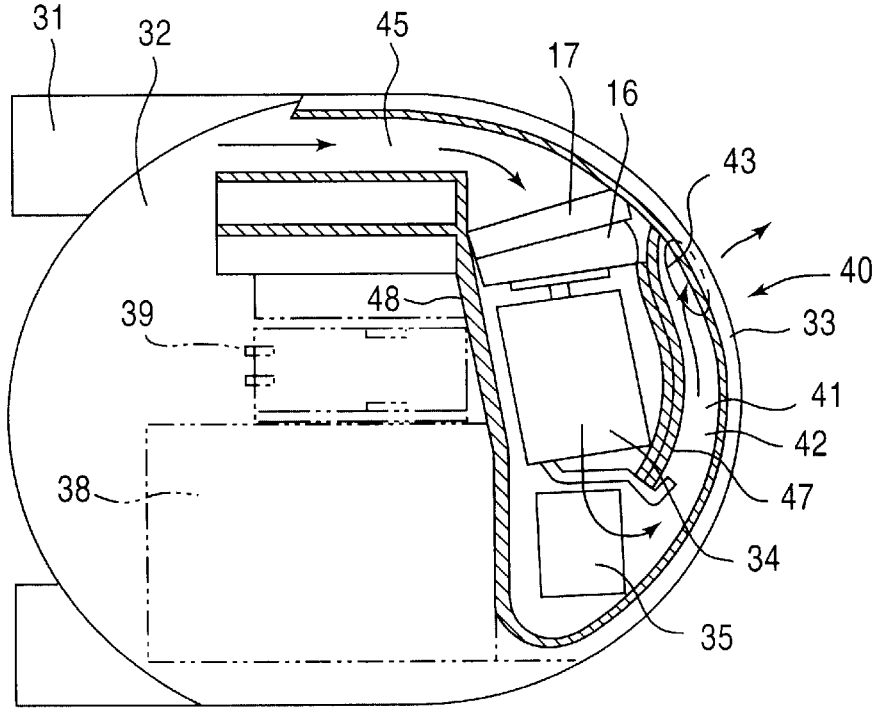
FIG.20 PRIOR ART
FIG. 20 is a fragmentary sectional top view of the hydraulic shovel to which a sound insulation housing of the prior art is applied with part thereof being omitted.
Figure 21:
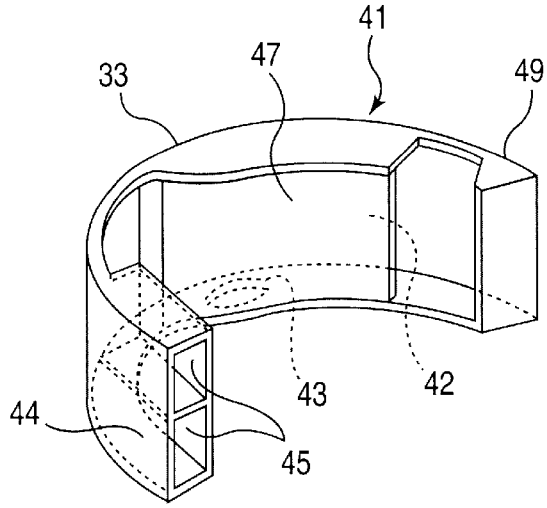
FIG. 21 PRIOR ART
FIG. 21 is a perspective view of a counterweight of the hydraulic shovel in FIG. 20.
Figure 22:
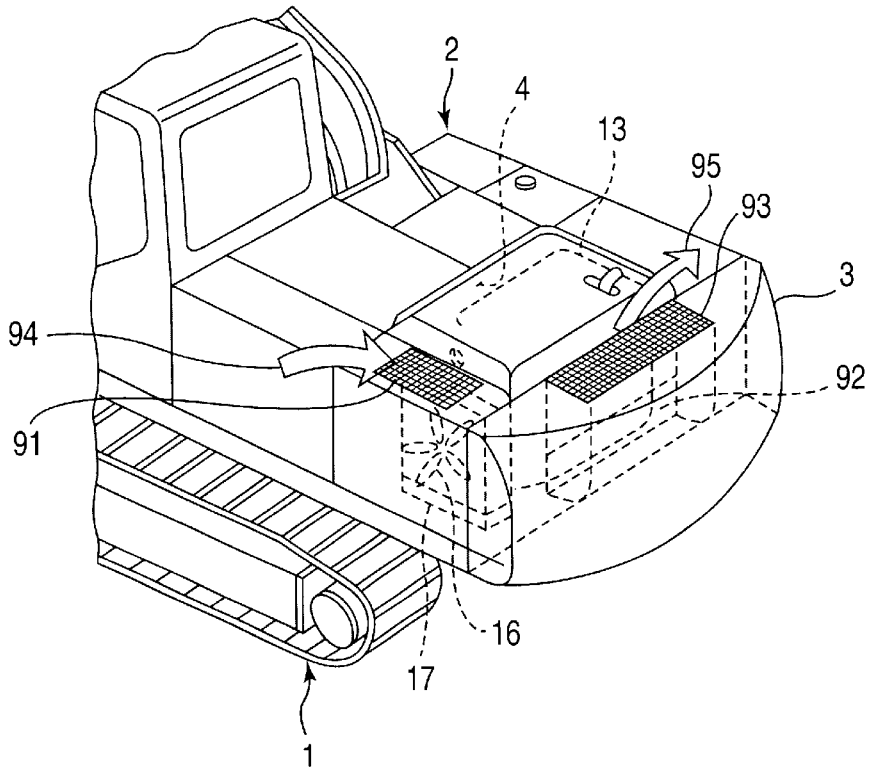
FIG. 22 PRIOR ART
FIG. 22 is a perspective view of an essential part of a hydraulic shovel including a cooling device according to the prior art.
Figure 23:
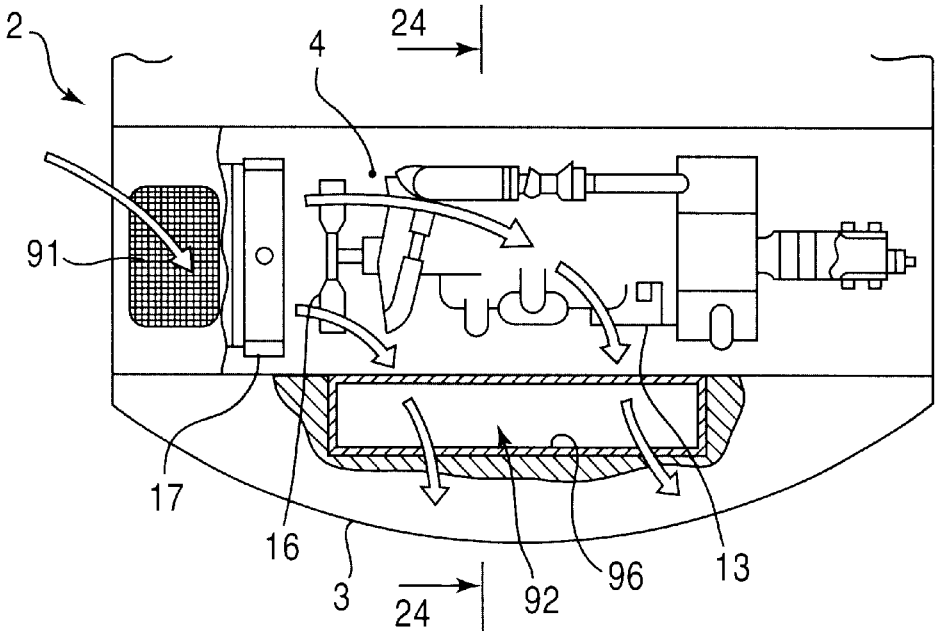
FIG.23 PRIOR ART
FIG. 23 is a partially cutaway plan view of an essential part of the hydraulic shovel in FIG. 22.
Figure 24:
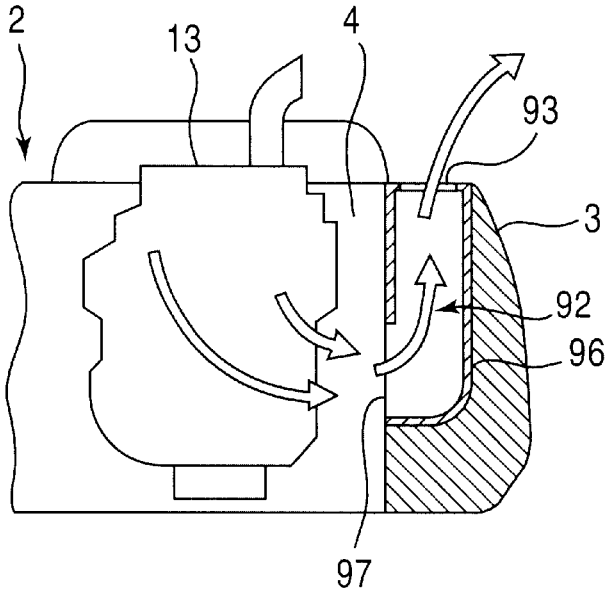
FIG.24 PRIOR ART
FIG. 24 is an explanatory view in the section take along the line 24—24 in FIG. 23.

FIG. 2 to FIG. 7 are explanatory views of a structure of the engine room 52 to which the engine cooling air passage of the first embodiment is applied. FIG. 2 is a top view of the engine room 52 seen from the counterweight 61 side, FIG. 3 is a side view seen in the direction of the arrow 3 in FIG. 2, and FIG. 4 is a side view seen in the direction of the arrow 4 in FIG. 2. FIG. 5 is a fragmentary sectional view of FIG. 2, FIG. 6 is a fragmentary sectional view of FIG. 3, and FIG. 7 is a fragmentary sectional view of FIG. 4. The thick arrows given to the pipelines show the direction of the flow of working fluid, and the same thing is applied hereinafter. The same components as in FIG. 18 are given the identical numerals and symbols, and the explanation thereof will be omitted below.

As shown in FIG. 5, in the engine room 52, an engine 13 is disposed with a crankshaft (not shown) being in parallel with a lateral direction of the counterweight 61, and a cooling fan 16 is placed in front of the engine 13 in FIG. 5. The cooling fan 16 may be driven in mechanical connection with an output shaft of the engine 13, or it may be hydraulically driven. At a portion in an upstream direction of a cooling air from the cooling fan 16, are placed a radiator 17, an oil cooler 18, and an air conditioning condenser 19. Thereby, the cooling air is designed to flow almost in parallel with the lateral direction of the counterweight 16. At an end portion of the engine 13 at a downstream side of the cooling air, attached are a hydraulic pump 15 as a power transducer, and an auxiliary pump 14.

In FIG. 2 to FIG. 7, a fan air diversion opening 53*a* is formed at a position near an air outlet of the cooling fan 16 in a left side partition wall 23*a* of the engine room 52 at the side close to the counterweight 61 (the left side, facing the upstream of the cooling air). The fan air diversion opening 53*a* is connected to one end portion of the fan air diversion passage 53 formed in the front portion of the counterweight 61. Similarly, a fan air diversion opening 54*a* is formed at a position near an air outlet of the cooling fan 16 in a right side partition wall 24*a* at the side in which a working fluid tank 5 is disposed (the right side, facing the upstream of the cooling air). Further, the fan air diversion duct or passage 54 one end portion of which is attached at the opening 54*a* is placed in the cooling air passage direction along an outer surface of the right side partition wall 24*a*. The other end portion of the fan air diversion duct or passage 54 has an opening 54*b* opened upward outside a right side surface of the engine room 52 at the cooling air downstream side.

Further, a fan air diversion opening 55*a* is formed at a position near the air outlet of the cooling fan 16, in an upper partition wall 25*a* provided on a top face of the engine room 52. The fan air diversion duct 55 one end portion of which is attached at the opening 55*a* is placed along an outer surface of the upper partition wall 25*a* in the cooling air passage direction. The other end portion of the fan air diversion duct 55 has an opening 55*b* opened to the outside at the cooling air downstream side.

A noise diffraction plate 56 is placed under the cooling air exhaust port 58 provided at a rear portion of the upper partition wall 25*a* of the engine room 52. Noise absorbing materials 54*c*, 54*d*, 54*e*, and 54*f* are attached on an inner wall of the fan air diversion duct or passage 54, and noise absorbing materials 55*c* and 55*d* are attached on an inner wall of the fan air diversion duct 55.

As shown in FIG. 5, a pipe line 67 running from the working fluid tank 5 adjacent to the engine room 52 to the auxiliary pump 14 is placed, penetrating through the fan air diversion duct or passage 54. A pipeline (oil line) 68 from the auxiliary pump 14 to the oil cooler 18, and a pipeline (oil line) 69 returning from the oil cooler 18 to the working fluid tank 5 are placed in a space inside the fan air diversion duct or passage 54.

Figure 8A:
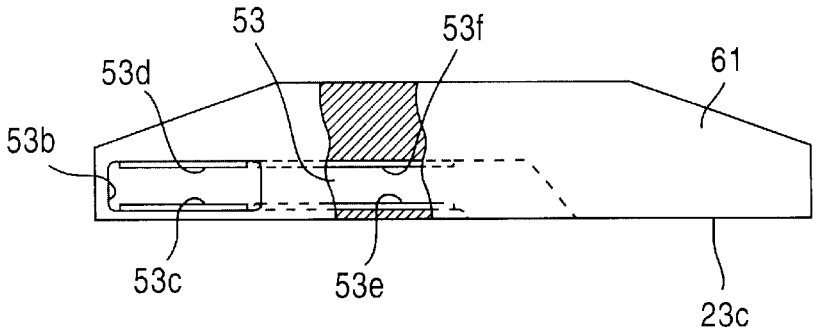
FIG. 8A and FIG. 8B are views of a first example of the counterweight according to the first embodiment.
Figure 8B:
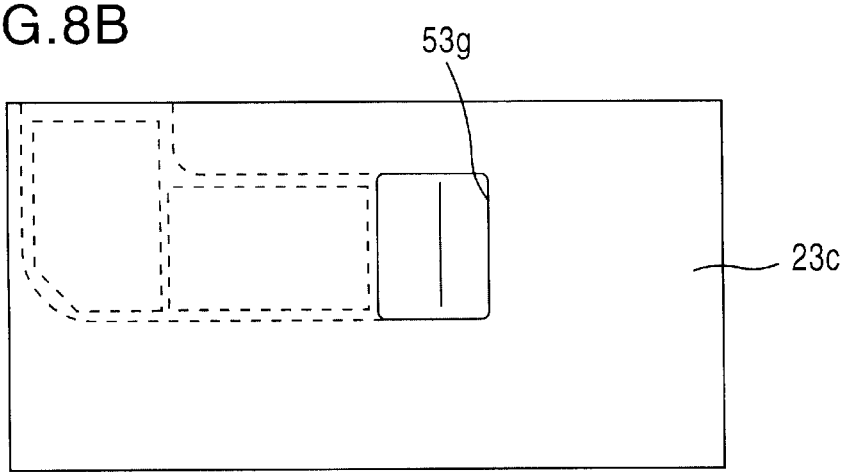
Figure 9:
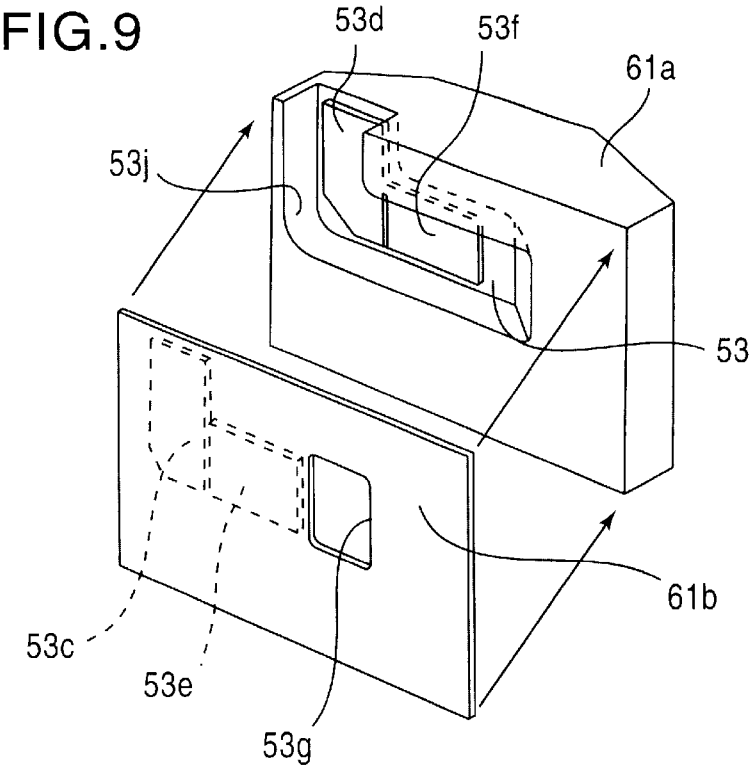
FIG. 9 is a sketch of a second example of the counterweight of the first embodiment.

FIG. 8A and FIG. 8B are views of a first example of the counterweight 61 according to the first embodiment, FIG. 8A shows a top view of the first example, and FIG. 8B shows a front view thereof, respectively. FIG. 9 shows a sketch of a second example of the counterweight 61 according to the first embodiment.

In FIGS. 8A and 8B, a face 23*c* in contact with the left side partition wall 23*a* of the engine room 52 (See FIG. 2) is provided on a front face of the counterweight 61. In the face 23*c*, an opening 53*g* is provided at a position conforming to the fan air diversion opening 53*a* (See FIG. 3) at the left side partition wall 23*a*. The fan air diversion passage 53 penetrating the inside of the counterweight 61 from the opening 53*g* is formed, and the other end side of the fan air diversion passage 53 is communicated with the opening 53*b* formed in the top surface of the counterweight 61. Further, noise absorbing materials 53*c*, 53*d*, 53*e*, and 53*f* are attached on an inner wall of the fan air diversion passage 53.

It should be noted that forming the fan air diversion passage 53 in the counterweight 61 is not limited to the aforesaid configuration. As shown in FIG. 9, for example, the counterweight 61 may have the configuration in which it is divided into a channel forming part 61*a* with a channel 53*j* being formed in the front face and a lid part 61*b* with the opening 53*g* being formed, and the fan air diversion passage 53 may be defined by the channel forming part 61*a* and the lid part 61*b*.

Next, the operation and effects of the first embodiment will be explained with reference to FIG. 1 to FIG. 9.

The engine room 52 shown in FIG. 2 to FIG. 4 is closely provided in front of the counterweight 61 shown in FIG. 8A and FIG. 8B, or in FIG. 9, whereby the engine cooling air passage shown by the thin line arrows in FIG. 5 is formed.

In FIG. 5, the air blown by the cooling fan 16 has the vectors with the air amounts and directions shown by the broken line arrows. Specifically, the air speed is higher as it is farther from a fan center in a radial direction and the air tends to spread in the radial direction by centrifugal force. Near the outer periphery of the cooling fan 16, high-speed blown air goes to each partition wall, and the fan air diversion opening 53*a* is provided at an area to which the vector faces. Thereby high-speed blown air near an outer periphery of the fan outlet directly flows into the fan air diversion opening 53*a* without resistance before cooling the engine, and flows while maintaining the high speed in a state near laminar flow by the fan air diversion passage 53 to be exhausted outside from the opening 53*b* (See FIG. 2).

Accordingly, a large amount of cooling air per opening area is exhausted from the fan air diversion passage 53, while inside the engine room 52, disturbance of the cooling air caused by collision against the partition walls near the outer periphery of the cooling fan 16 is eliminated and the residual air flow passes smoothly, whereby the back pressure of the cooling fan 16 is reduced to a large extent owing to both of the above effects. As a result, even if the opening area of the cooling air exhaust port 58 in the top face of the engine room 52 at the downstream side is reduced to be less than the opening area of the cooling air exhaust port according to the prior art by the the opening area of the fan air diversion passage 53 or more, the back pressure can be reduced to the same or less, thus making it possible to secure the same amount of engine cooling air passing the radiator 17 or more.

As a result, noise inside the engine room 52 is attenuated by the fan air diversion passage 53 of the aforesaid predetermined length and released outside on one hand, and on the other hand, it is released from the cooling air exhaust port 58 of which area is drastically reduced, thus producing a profound effect of reducing the ambient noise. Further, since the opening area of the cooling air exhaust port 58 is small, it is possible to place the small noise diffraction plate 56 without increasing the back pressure of the cooling fan, thus making it possible to further reduce the noise released from the cooling air exhaust port 58.

The fan air diversion passage 53 is explained above, but other than this, in the engine room 52, the fan air diversion duct or passage 54 is provided at the right side partition wall 24*a*, and the fan air diversion duct 55 is provided on the upper partition wall 25*a*, the operations and effects of which are the same as the aforesaid fan air diversion passage 53. Consequently, any of the fan air diversion passage or fan air diversion ducts can be used individually or plurality of them can be used in combination. Further, it is possible to provide a fan air diversion duct (not illustrated) along the outer surface of the engine room 52 at the left side partition wall 23*a* as in the right side partition wall 24*a* and omit the fan air diversion passage inside the counterweight 61. The fan air diversion duct along the outer surface is provided opposite in direction to the fan air diversion duct or passage 54.

If the diameter of the cooling fan 16 is d, it is preferable that a distance L1 between the center line of the cooling fan 16 and the farther end portion of each of the fan air diversion openings 53*a*, 54*a*, and 55*a* relative to the cooling fan, is "d/4 to d". Further, it is preferable that a distance L2 from the outer peripheral end portion of the cooling fan 16 to each of the fan air diversion openings 53*a*, 54*a* and 55*a* is "(⅔) d" at the maximum.

Further, as shown in FIGS. 8A and 8B, since the fan air diversion passage 53 is placed inside the counterweight 61, a space for the fan air diversion passage 53 becomes unnecessary, which makes the engine room compact, when it is mounted on the hydraulic shovel. Especially when only the fan air diversion passage 53 is implemented or when it is implemented in combination with the fan air diversion duct 55, the engine room with the same space as in the prior art can be mounted on the hydraulic shovel (not illustrated). When the fan air diversion passage 53 is implemented in combination with the fan air diversion duct 55, the fan air diversion duct 54 is omitted.

As shown in FIG. 9, the counterweight 61 may be defined by the channel forming part 61*a* and the lid part 61*b*. Thereby, not only the fabrication of the counterweight 61 is facilitated, but also the configuration is simplified by using the left side partition wall 23*a* (See FIG. 2) of the engine room 52 in place of the lid part 61*b*.

Further, as shown in FIG. 2 to FIG. 4, the noise absorbing materials 53*c*, 53*d*, 53*e* and 53*f* are attached on the inner wall of the fan air diversion passage 53, the noise absorbing materials 54*c*, 54*d*, 54*e* and 54*f* are attached on the inner wall of the fan air diversion duct 54, and the noise absorbing materials 55*c* and 55*d* are attached on the inner wall of the fan air diversion duct 55. Consequently, the noise passing the inside of the fan air diversion passage 53, the fan air diversion ducts or passage 54 and 55 are in contact with each absorbing material over the large area. Thus, in addition to low-frequency band noise being attenuated by the fan air diversion passage 53 or the fan air diversion ducts 54 and 55 themselves, high-frequency band noise is attenuated to a large extent. As a result, the noise is not only attenuated, but also transmits less offensive noise to the ear.

Furthermore, as shown in FIG. 5 and FIG. 7, since the pipelines 68 and 69 connecting to the oil cooler 18 are placed in the inner space of the fan air diversion duct 54, the space for placing the pipelines can be reduced and the pipelines can be cooled at the same time as will be described hereinafter.

Initially, as for the space for placing the pipelines, the pipelines are normally placed with a predetermined space being left around the lines for prevention of the interference due to vibration caused by the pressure pulsation of inner fluid and for maintainability (for example, easiness in individual attachment and detachment). Consequently, placing the pipelines requires the space several times as large as the volume of the lines, which becomes a large dead space. According to the present embodiment, since the pipelines 68 and 69 are placed in the inner space of the fan air diversion duct or passage 54, the aforesaid dead space can be utilized as the passage for fan air, which is highly effective in reducing the space for placement and making it possible to reduce construction equipment in size.

Next, as for cooling of the pipelines, since a hydraulic shovel drives the working machine, carrier, and the like with hydraulic pressure, a large-sized oil cooler for preventing the temperature of working fluid from rising is essential. According to the present embodiment, since the pipelines 68 and 69 connecting to the oil cooler 18 are placed in the inner space of the fan air diversion duct 54, they are cooled with the fan diversion air. Thereby, heat amount which has to be cooled by the oil cooler 18 is reduced, which makes it possible to reduce the thickness of an air-cooled type of oil cooler core or increase the interval between cooling fins under a fixed amount of cooling air. Accordingly, resistance against passage of the cooling air is reduced while air flow increases, and the rotational frequency of the cooling fan 16 can be reduced or the fan can be made compact correspondingly, thus reducing consumed horse power of the cooling fan 16. Thereby, fan noise can be reduced, fuel consumption of the hydraulic shovel can be decreased, and residual engine horse power can be used for driving the working machine, the base carrier and the like, thus making it possible to improve workability and traveling.

According to each operation and effect in the above first embodiment,.an engine cooling air passage capable of realizing a compact hydraulic shovel with less noise and less fuel consumption can be easily obtained.

Next, a second embodiment shown in FIG. 10 to FIG. 16B will be explained.

Figure 10:
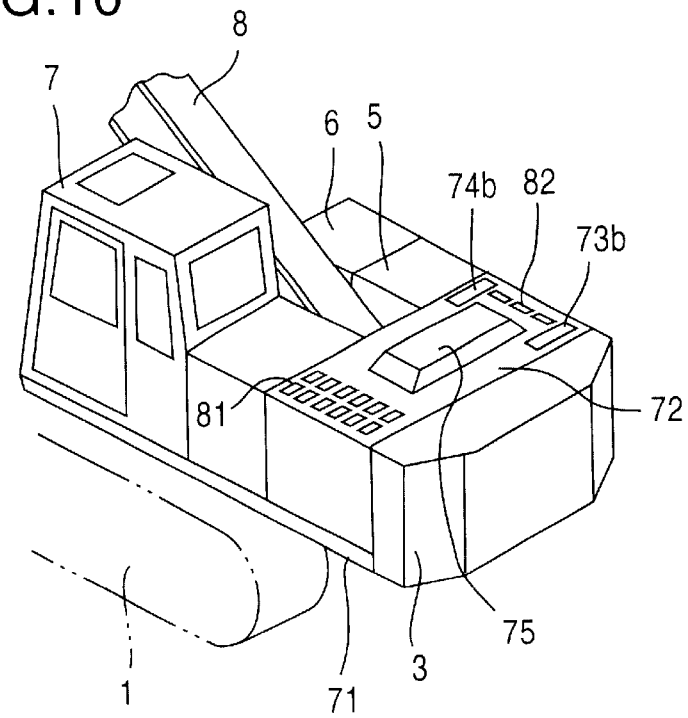
FIG. 10 is a fragmentary perspective view of a hydraulic shovel to which an engine cooling air passage of a second embodiment of the present invention is applied.

FIG. 10 shows a fragmentary perspective view of a hydraulic shovel to which an engine cooling air passage of the second embodiment is applied. The same components as in FIG. 17 are given the identical numerals and symbols and the explanation thereof will be omitted below.

In FIG. 10, an upper revolving superstructure 71 is rotatably mounted at approximately a center of a top portion of the base carrier 1, a counterweight 3 is provided at an upper rear end portion of the upper revolving superstructure 71, and an engine room 72 is placed in front of the counterweight 3. On a top face of the engine room 72, a cooling air inlet port 81 is provided at a front of the engine room top face and a cooling air exhaust port 82 is provided at a rear of the engine room top face. Openings 73*b* and 74*b* of the fan air diversion ducts are provided at a left and right side of a rear portion (at a right side of the vehicle body) of the engine room 72, and a fan air diversion duct 75 is placed at approximately a center of a top portion of the engine room 72.

Figure 11:
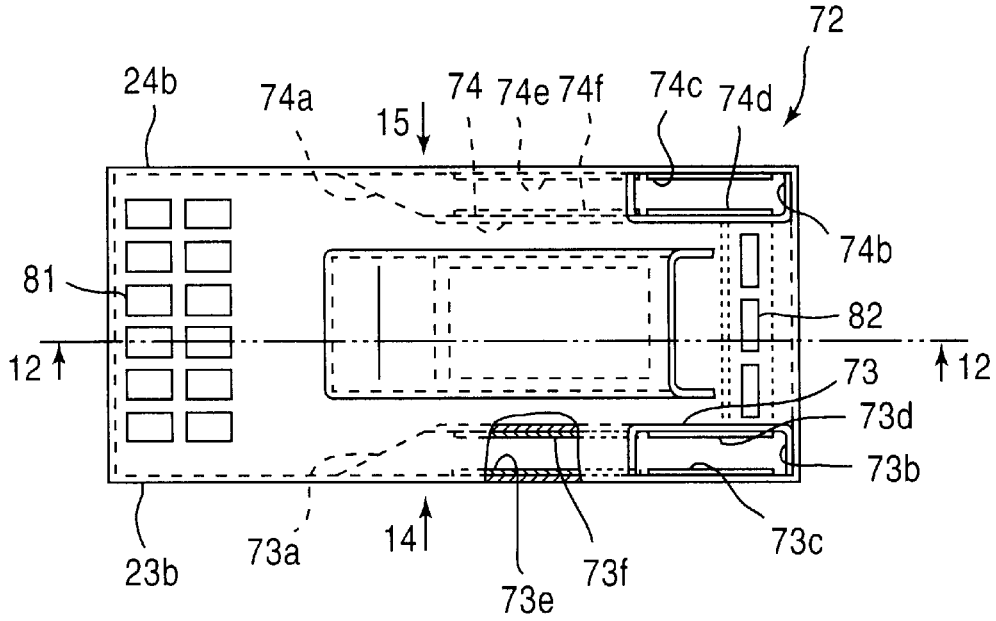
FIG. 11 is a top view of an engine room of the second embodiment.
Figure 12:
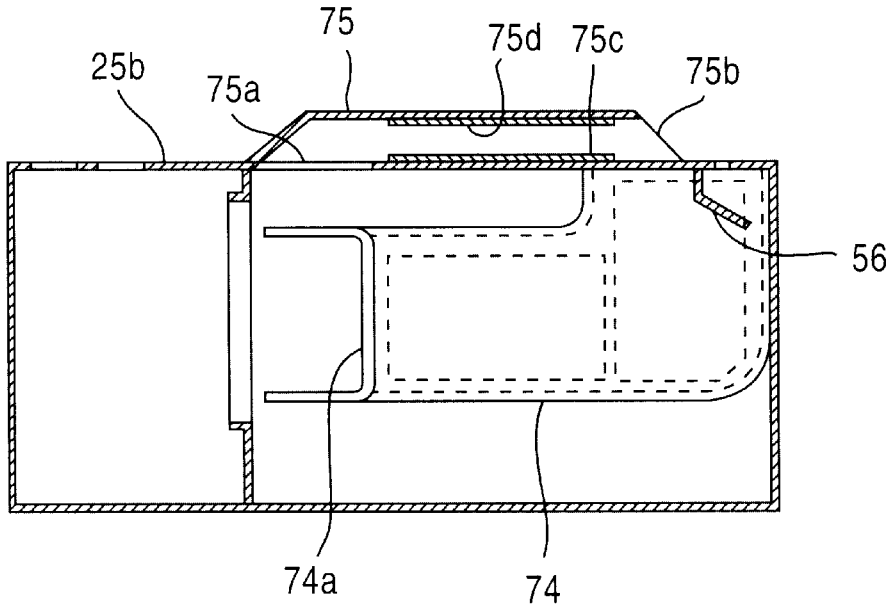
FIG. 12 is a sectional view taken along the line 12—12 in FIG. 11.
Figure 13:
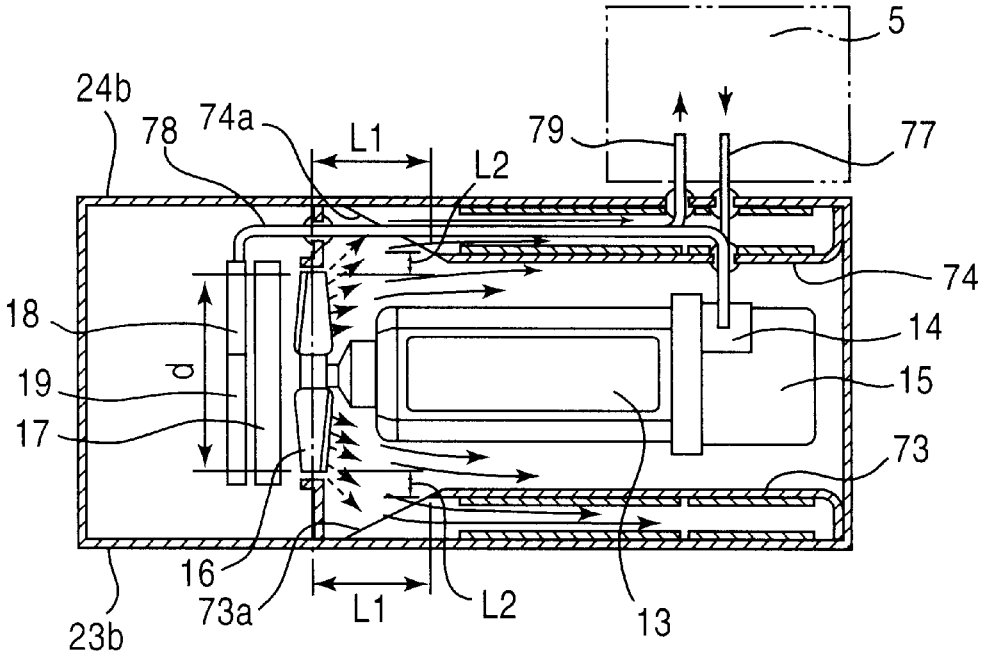
FIG. 13 is a fragmentary sectional view of FIG. 11.
Figure 14:
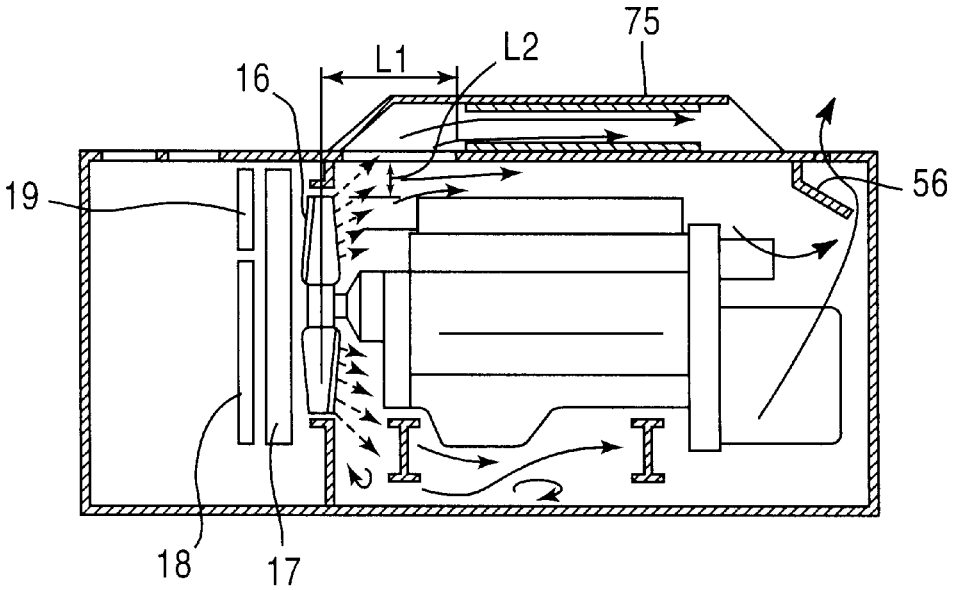
FIG. 14 is a fragmentary sectional view seen from the arrow 14 in FIG. 11.
Figure 15:
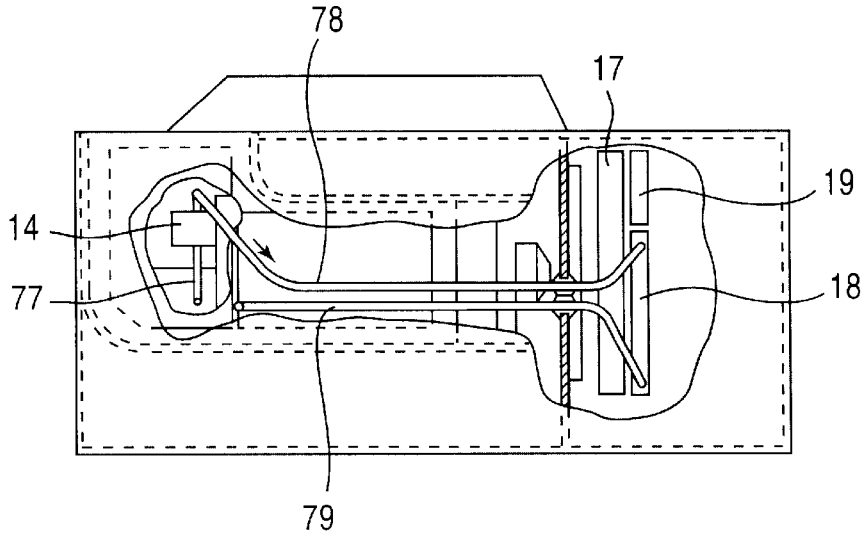
FIG. 15 is a fragmentary sectional view seen from the arrow 15 in FIG. 11.

FIG. 11 to FIG. 15 are explanatory views of a configuration of the engine room 72 to which the engine cooling air passage of the second embodiment is applied. FIG. 11 shows a top view of the engine room 72, and FIG. 12 shows a sectional view taken along the line 12—12 in FIG. 11. Further, FIG. 13 is a fragmentary sectional view of FIG. 11, FIG. 14 is a fragmentary sectional view seen from the arrow 14 in FIG. 11, and FIG. 15 is a fragmentary sectional view seen from the arrow 15 in FIG. 11. It should be noted that the same components as in the drawings shown in the first embodiment and the prior art are given the identical numerals and symbols and the explanation thereof will be omitted.

In FIG. 11 to FIG. 15, the engine 13, the cooling fan 16, the radiator 17, the oil cooler 18 and the air conditioning condenser 19 are placed in a predetermined orientation inside the engine room 72. The hydraulic pump 15 and the auxiliary pump 14 are attached at an end portion at a downstream side of cooling air for the engine 13. A fan air diversion duct 73 is provided in a direction of a cooling air passage, along an inner surface of the left side partition wall 23*b* on the left side facing a cooling air upstream of the engine room 72. A fan air diversion opening 73*a* is provided at an upstream side of the duct 73 so as to be located near the air outlet of the cooling fan 16, and the exhaust opening 73*b* is provided in the upper partition wall 25*b* of the engine room 72 at a down stream side of the duct 73.

A fan air diversion duct 74, an fan air diversion opening 74*a* and the exhaust opening 74*b* are provided at the right side partition wall 24*b* side on the right side facing the upstream of the cooling air of the engine room 72. Further, a fan air diversion opening 75*a* is provided at a position near the air outlet of the cooling fan 16 in the upper partition wall 25*b* of the engine room 72. The fan air diversion duct 75 with one end portion being attached at the opening 75*a* is placed along the outer surface of the upper partition wall 25*b*, and it has an opening 75*b* at the other end of the duct 75 at the downstream side of the engine room 72.

Noise absorbing materials 73*c*, 73*d*, 73*e*, and 73*f* are attached on an inner wall of the fan air diversion duct 73, noise absorbing materials 74*c*, 74*d*, 74*e*, and 74*f* are attached on an inner wall of the fan air diversion duct 74, and noise absorbing materials 75*c* and 75*d* are attached on an inner wall of the fan air diversion duct 75.

Further, as shown in FIG. 13 and FIG. 15, a pipeline 77 running from the working fluid tank 5 adjacent to the engine room 72 to the auxiliary pump 14 is provided to penetrate through the fan air diversion duct 74. A pipeline (oil line) 78 running from the auxiliary pump 14 to the oil cooler 18, and a pipeline (oil line) 79 returning from the oil cooler 18 to the working oil tank 5 are provided in an inner space of the fan air diversion duct 74.

Figure 16A:
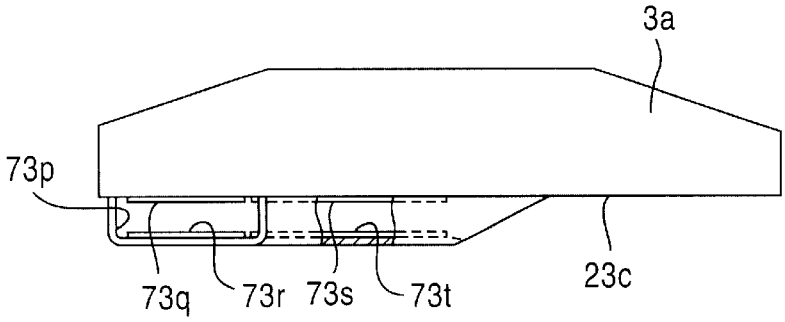
FIG. 16A and FIG. 16B are explanatory views of another embodiment directed to the engine room in which the engine cooling air passage according to the second embodiment is formed.
Figure 16B:
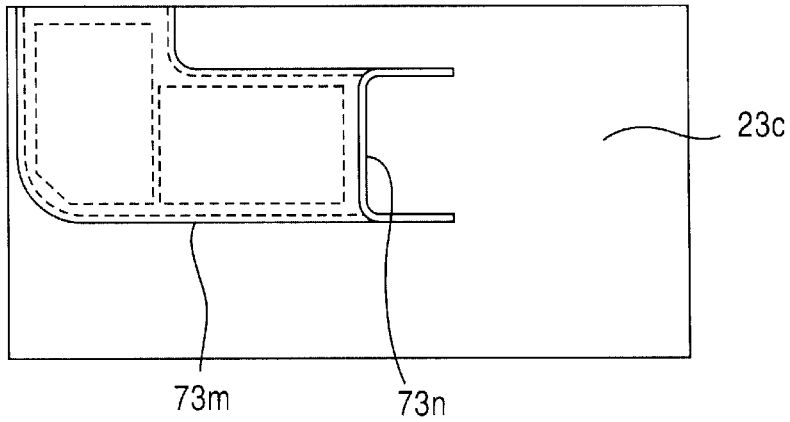

FIGS. 16A and 16B are explanatory views of another mode for carrying out the engine room with the engine cooling air passage according to the second embodiment being formed, and FIG. 16A is a top view of the counterweight, and FIG. 16B is a front view of the counterweight.

As shown in FIGS. 16A and 16B, the face 23*c* may be provided on a front face of a counterweight 3*a*, and a fan air diversion duct 73*m* similar to the fan air diversion duct 73 (See FIG. 11 and FIG. 13), a fan air diversion opening 73*n* and an exhaust port 73*p* may be provided along the face 23*c*. Further, noise absorbing materials 73*q*, 73*r*, 73*s* and 73*t* are attached on an inner wall of the fan air diversion duct 73*m*.

The operation and effects of the second embodiment will be explained with reference to FIG. 11 to FIG. 16B.

In FIG. 11, the fan air diversion ducts 73 and 74 are placed inside the engine room 72 and thereby the engine room 72 is made approximately a rectangular parallelepiped, whereby the engine cooling air passages as shown by the arrows of a thin line in FIG. 13 and FIG. 14 can be formed.

Thus, the same operation and effects as in the first embodiment other than the operation and effects of the fan air diversion passage 53 (FIGS. 8A, 8B and 9) being formed inside the counterweight 61 can be obtained.

Further, since the engine room 72 in the second embodiment is approximately a rectangular parallelepiped, flexibility in layout such as a layout in a horizontal or vertical orientation is increased, thus making the engine room 72 applicable to medium and large sized construction equipment. Here, the layout in a lateral orientation means the placement with the rotational axis of the engine being in a lateral direction of the vehicle, and the layout in a vertical orientation means the placement with the rotational axis of the engine being in a longitudinal direction of the vehicle.

Above all, in portable engine loaded devices such as a portable engine motor, a portable compressor and the like in which the appearance of the engine room is the appearance of the product as it is, by replacing the hydraulic pump 15 shown in FIG. 13 with a generator, a compressor or the like, it is easily applied, and an engine room, which is easy to carry with excellent appearance quality and low noise, can be constructed. As a result, an engine cooling air passage, which can be applied to various kinds of engine loaded devices with general versatility, and which can realize compact construction equipment with less noise and improved fuel efficiency, can be obtained.

In FIGS. 16A and 16B, by using the face 23*c* at the front of the counterweight 3*a* in place of the entire or part of the left side partition wall 23*b* (See FIG.11) of the engine room 72, the left side partition wall 23*b* can be omitted or reduced, and thus the same operation and effects as in the above can be also obtained in this case.

As explained thus far, since the effects described below is produced according to the present invention, it is applicable to portable engine devices and construction equipment such as a construction vehicle from a small to large model and the like, and the engine cooling air passage for construction equipment which achieves reduction in size, noise and fuel consumption at the same time can be obtained.

(1) In the construction equipment in which predetermined partition walls enclose the engine for reducing the ambient noise to construct the engine room, the fan air diversion opening formed in the engine room partition wall near the air outlet portion of the cooling fan for the engine, and the fan air diversion duct or the fan air diversion passage of a predetermined length communicated with the fan air diversion opening are provided. According to the structure, before high-speed air blown from the fan outer periphery portion cools the engine in the engine room, it directly flows into the fan air diversion opening without resistance, and it further flows through the diversion duct or the diversion passage in a state near laminar flow while maintaining high speed and is discharged outside. Thereby, disturbance by high-speed cooling air is eliminated at the partition walls near the fan outer periphery portion, and the remaining amount of air flows smoothly in the engine room, thus drastically reducing the cooling fan back pressure owing to both the effects. Consequently, even if the opening area of the cooling air exhaust port at the back of the engine room is reduced to a large extent, the back pressure is the same as or less than the prior art, thus making it possible to secure sufficient amount of cooling air. Accordingly, the noises in the engine room are attenuated while passing through the aforesaid diversion duct and released outside on one hand, and the noises are released outside from the cooling air exhaust port drastically reduced at the back of the engine room on the other hand, thus substantially reducing the ambient noise. As the result, according to the present engine cooling air passage, the construction equipment with less noise can be provided.

(2) In the construction equipment such as a hydraulic shovel having a counterweight, by providing a fan air diversion passage inside the adjacent counterweight, an engine room capable of reducing noise can be mounted in almost the same space as in the prior art. Accordingly, according to the engine cooling air passage of the invention, construction equipment compact in size with less noise can be provided.

(3) In the construction equipment in which the surroundings of the engine is enclosed with the partition walls for reducing the ambient noise to form the engine room, the fan air diversion duct is provided along the inside surface of the engine room partition walls, and the opening at the upstream side of the same duct being located near the outer periphery of the air outlet portion of the cooling fan while at the downstream side, the duct penetrates through the engine room partition wall to be opened to the outside. Thus, the engine room can be formed into approximately a rectangular parallelepiped. Consequently, according to the engine cooling air passage of the invention, an approximately rectangular parallelepiped engine room having layout (horizontal and vertical orientation, or the like) flexibility with less noise can be provided.

Large-sized construction equipment is often used incorporated in the continuous production system in a quarry for air port construction, limestone mine for cement, and various kinds of other mines, and a trouble in the equipment causes the system to stop. Thus, to minimize the down time, unit configuration with which a unit can be replaced for each device having trouble is generally employed. In this case, since the engine room with less noise is approximately a rectangular parallelepiped, therefore making it possible to provide construction equipment with unit replacement being facilitated and with less noise.

(4) Of construction equipment, in portable engine loaded devices such as a portable engine motor, a portable air compressor, and the like, by using the configuration of approximately a rectangular parallelepiped engine room with less noise according to the present invention, excellent appearance of the product can be provided. Thus, a portable engine loaded device having high commercial value with less noise and excellent appearance can be provided.

(5) Further, by placing the hydraulic pipelines in the inner space of the fan air diversion duct or the diversion Get passage, reduction in the piping space and the cooling of the pipelines can be achieved at the same time. Specifically, the dead space around the pipelines can be used as the fan air passage, the piping space can be saved. Further, since the pipelines to and from the oil cooler are cooled by reusing the fan diversion air, the heat amount which has to be cooled by the oil cooler is decreased, and the air-cooled oil cooler core can be made thinner or the interval between the cooling fins can be made larger. Consequently, the resistance against the passage of the cooling air decreases, while the amount of fan air increases, and the fan rotational frequency can be reduced correspondingly, thus making it possible to reduce the consumed horse power of the fan. As the result, construction equipment compact in size with low fuel consumption and less noise can be provided.

(6) By attaching the noise absorbing materials on the inner surface of the fan air diversion duct or the diversion passage, the noise passing through the duct or the passage is drastically attenuated in high-frequency band in addition to the attenuation by the duct itself. Accordingly, not only further reduction in noise can be realized, but also the noise becomes less offensive to the ear. Specifically, the sound with less high-frequency band sounds comfortable to the human auditory sense, even if the total sound pressure level (dB) (the sum of the sound pressure level of each frequency band) by a simple noise meter is not changed, and thus the commercial value can be increased.

Similarly, in order to equally assess various noises in the environmental noise control, the value showing an equivalent permissible level for each frequency band (unit; NdB)

is often used, and a lower level is demanded in the higher frequency band. Regarding this, according to the above configuration, it is made possible to clear more rigorous level. Consequently, according to the engine cooling air passage, construction equipment applicable to the environmental noise control can be provided.

Though the explanation is made with a hydraulic shovel is cited as an example of construction equipment above, the present invention is not limited thereto, and it is applicable to many kinds of construction equipment, whereby the same operation and effects can be obtained. Specifically, due to the necessity for reducing the ambient noise, in most construction equipment, the engine is enclosed with the partition walls so that the engine room is defined, whereby it is a common issue to secure sufficient amount of engine cooling air, and reduce noise and size of the engine room at the same time. Regarding the above, the present invention can provide construction equipment from small to large in size with less noise, which is capable of solving the issue, as described above.

Further, construction equipment, which is utilized on lease and rental in many cases, is demanded to be less noisy in order to be usable in any place and at any time such as in a construction work at night in a city area. According to the present invention, construction equipment with reduction in noise corresponding to the demand and with higher customer satisfaction index can be provided.

What is claimed is:

1. An engine cooling air passage for construction equipment in which an engine room enclosing an engine, a radiator and a cooling fan for cooling said radiator is adjacently placed in front of a counterweight at a rear end portion of a vehicle so that a direction of an axis of rotation of said cooling fan is in a lateral direction of the vehicle, and outside air is taken in by said cooling fan and is discharged to the outside via an inside of said engine room, said engine cooling air passage comprising:

a fan air diversion passage of a predetermined length, which has at one end a fan air diversion opening located near an outer periphery portion of said cooling fan for taking in cooling air blown by said cooling fan, and has at the other end an opening located at a lateral end portion of said counterweight for discharging to the outside said cooling air taken in, said fan air diversion passage being formed either in a front portion of or in a front face of said counterweight, and said fan air diversion passage being separated from said engine by a wall having openings for taking in and discharging said cooling air.

2. The engine cooling air passage for the construction equipment in accordance with claim 1, wherein noise absorbing materials are attached on an inner wall of said fan air diversion passage.

3. An engine cooling air passage for construction equipment in which an engine room partially defined by upper and side partition walls and enclosing an engine, a radiator and a cooling fan for cooling said radiator is provided, and outside air is taken in by said cooling fan and is discharged to the outside via an inside of said engine room, said engine cooling air passage comprising:

a fan air diversion duct of a predetermined length, which has at one end a fan air diversion opening located near an outer periphery portion of said cooling fan at a front end of said engine room for taking in cooling air blown by said cooling fan, and has at the other end an opening at a back end of said engine room for discharging to the outside said cooling air taken in, said fan air diversion duct being provided at least at either one of a side of said engine and above said engine, said fan air diversion duct being partially defined by said partition walls, and said fan air diversion duct being separated from said engine by a wall having openings for taking in and discharging said cooling air.

4. The engine cooling air passage for the construction equipment in accordance with claim 3, wherein noise absorbing materials are attached on an inner wall of said fan air diversion duct.

5. An engine cooling air passage for construction equipment in which an engine room partially defined by upper and side partition walls and enclosing an engine, a radiator and a cooling fan for cooling said radiator is provided, and outside air is taken in by said cooling fan and is discharged to the outside via an inside of said engine room, said engine cooling air passage comprising a fan air diversion duct of a predetermined length, which has at one end a fan air diversion opening located near an outer periphery portion of said cooling fan for taking in cooling air blown by said cooling fan, and has at the other end an opening for discharging to the outside said cooling air taken in, said fan air diversion duct being provided at least at either one of a side of said engine and above said engine, wherein oil pipelines provided inside said engine room and connecting an oil cooler for cooling working fluid of a hydraulic device, and a working fluid tank are placed in an inner space of said fan air diversion duct.

* * * * *